United States Patent [19]

van der Ven

[11] 3,979,631

[45] Sept. 7, 1976

[54] CATHODE RAY TUBE WITH ELECTROSTATIC MULTIPOLE FOCUSING LENS

[75] Inventor: Robert Fransiscus Laurentius Maria van der Ven, Eindhoven, Netherlands

[73] Assignee: U.S. Philips Corporation, New York, N.Y.

[22] Filed: Apr. 10, 1975

[21] Appl. No.: 566,732

[30] Foreign Application Priority Data

Apr. 25, 1974 Netherlands ..... 7405552

[52] U.S. Cl. ..... 313/450; 313/457

[51] Int. Cl.² ..... H01J 29/02; H01J 29/58; H01J 29/62

[58] Field of Search ..... 313/448, 457, 456, 451, 313/449, 447, 450, 452

[56] References Cited

UNITED STATES PATENTS

| | | | |
|---|---|---|---|
| 2,058,293 | 10/1936 | Broadway et al. | 313/457 |
| 2,064,981 | 12/1936 | Knoll | 313/457 |
| 2,227,087 | 12/1940 | Hinsch | 313/451 |
| 2,509,254 | 5/1950 | Selgin | 313/448 X |
| 2,740,063 | 3/1956 | Groendijk et al. | 313/456 X |
| 3,354,340 | 11/1967 | Almer et al. | 313/447 |
| 3,355,617 | 11/1967 | Schwartz et al. | 313/450 |

*Primary Examiner*—Robert Segal
*Attorney, Agent, or Firm*—Frank R. Trifari; George B. Berka

[57] ABSTRACT

A cathode ray tube wherein conductive supporting members of a focusing electrode, in combination with the conductive coating around the envelope, constitute an electrostatic multipole focusing lens.

8 Claims, 3 Drawing Figures

CATHODE RAY TUBE WITH ELECTROSTATIC MULTIPOLE FOCUSING LENS

The invention relates to a cathode ray tube comprising means to generate an electron beam, means to focus the said electron beam to a spot on a target extending in the tube substantially at right angles to the longitudinal axis thereof, and means to support a focusing electrode belonging to the said focusing means, said focusing electrode, on its side facing the target, forming an electrostatic lens in combination with an electrically conductive coating provided on the interior of the envelope of the tube.

A cathode ray tube in which an electron beam is focused on the display screen by means of an electrostatic system of lenses is known, for example, from the U.S. Pat. No. 2,185,378. It is stated in said Patent Specification that the lens action can be obtained by means of a cylindrical electrode in combination with a conductive coating on the envelope of the tube.

The systems of lenses commonly used for cathode ray tubes are restricted to those of the unipotential type and those of the bipotential type. In the former type the lens usually consists of three cylindrical electrodes which are centred along an axis and are placed at a certain axial distance from each other, the first and the last electrode of which convey the same voltage while the intermediate electrode, sometimes referred to as the focusing electrode, conveys a considerably lower voltage than the said first and last electrode.

A lens of the bipotential type consists generally of a first and a second electrode, the second electrode usually conveying a considerably higher voltage than the first. The electrons will therefore leave said lens at a higher velocity than that at which they enter the lens. For that reason, said type of lens is therefore sometimes referred to as an accelerating lens in contrast with the above-described unipotential lens in which the electrons experience velocity variations within the lens, it is true, but in which the velocities at which an electron enters and leaves the lens are equal to each other.

Both in lenses of the unipotential type and in those of the bipotential type it is common practice that the last electrode is connected electrically, by means of contact springs, to a conductive coating provided on the interior of the tube wall. Furthermore it is usual to position and fix the electrodes very near to each other by means of supporting members which are secured thereto and the free ends of which are sealed in glass assembly rods. However, the use of such assembly rods is associated with several drawbacks. For example, said insulating rods may exert a disturbing influence on the path of the electron beam due to static charging, notably in those cases where there is a certain axial space between successive electrodes of the electron gun. Furthermore, said rods occupy a certain space in the tube which is not effectively used and, at least for a single gun, they form a restricting factor with respect to the minimum inside diameter of the neck of the tube. Due to the fact that voltage differences of 20 kV or more between electrodes which are placed at a short distance from each other are quite usual, very high requirements should furthermore be imposed upon the insulating capacity of the glass rods.

It is an object of the invention to provide a system of electron guns of particularly simple construction in which the use of such insulating assembly rods is avoided and of which the dimensions are minimized both in the axial and in the radial direction.

According to the invention, a cathode ray tube comprising a focusing electrode which on its side facing the target forms an electrostatic lens in combination with an electrically conductive coating provided on the interior of the envelope is characterized in that the means to support the said focusing electrode consist of a number of mainly axially extending electrically conductive supporting members which are surrounded by the said conductive coating.

Said supporting members serve not only to support and secure the focusing electrode but also have an electron-optical function and, according to the invention, constitute an electrostatic multipole lens preferably in combination with the said conductive coating.

According to the invention, the means to support the focusing electrode preferably consists of 4 metal pins which are positioned at equal distances from each other and extend parallel to the longitudinal axis of the gun and which form an electrostatic octupole with said conductive coating. The focusing action of such an octupole is such that with a suitable choice of the potentials a substantially rectangular spot can be formed on the target instead of a circular spot. This has the advantage that the lines written on the target by the electron beam are better filled, in other words a better intensity distribution is obtained, than in the case of a circular target.

The conductive coating as meant above adjoins the conductive coating which in the known cathode ray tubes usually extends between the system of electron guns and the target and which is connected to the high voltage contact. As already noted, the high voltage in the known gun constructions is transmitted via contact springs to one or more electrodes which are insulated electrically from the other electrodes of the gun by means of glass assembly rods. The possibility that an electric breakdown occurs between such a high voltage electrode and another electrode present at a short distance therefrom is very large. In a system of electron guns according to the invention this possibility of breakdown is considerably reduced because a clear separation has been provided between those electrodes which convey a high voltage and those which convey a comparatively low voltage.

The electrodes which convey a comparatively low voltage as compared with the high voltage are, in addition to the focusing electrode itself, the cathode, the control electrode and the anode. The three last-mentioned electrodes together constitute the triode part of the gun as it is found in nearly any electron gun. According to the invention, said triode part preferably is of a construction similar to that published in the U.S. Pat. No. 2,975,315, in particular in FIG. 1 thereof. In this specification the control electrode is surrounded by an anode and mechanically secured thereto by means of a ring of insulating material present between the cylinder surfaces of said electrodes. In a similar construction according to the invention the supporting members of the focusing electrode are secured in the insulating material present between the anode and the control electrode. For that purpose, according to the invention, a number of apertures are present in the end face of the anode through which the said supporting members are led. Said supporting members determine the distance between the anode and the boundary of the focusing electrode facing same. In the case of a short distance between anode and focusing electrode the potential distribution along the longitudinal axis of the electrode system will approach that of an accelerating lens, while in the case of an increase of said distance the lens shows rather the character of a unipotential lens. Thus various transition forms from an accelerating lens to a uni-potential lens can be realized.

According to the invention, at least one of the supporting members also serves as a supply conductor of the electric potential for the focusing electrode and the remaining supporting members connected thereto.

In order to avoid an electric breakdown between the wall coating conveying a high potential and the ends of the supporting members secured to the focusing electrode, the focusing electrode according to the invention has a collar below which the said ends are welded or soldered to the electrode.

The focusing electrode may consist of a mainly cylindrical sleeve but is by no means restricted thereto. According to the invention the focusing electrode may also consist of a grid formed by a wire which is wound around the supporting members.

Furthermore the invention is not restricted to a single conductive coating on the envelope of the tube. According to the invention it is also possible to use wall coating which are separated relative to each other, for example, a first conductive coating which in cooperation with the focusing electrode forms an accelerating lens, and a second conductive coating which in cooperation with the supporting members of the focusing electrode forms a multipole lens. the said coatings need not convey the same potential. The voltage for the first coating may be supplied via the high voltage contact, while the second coating may be connected electrically, via a contact spring, to a lead-through pin sealed in the tube cap and can thus be brought at a desired potential.

The invention will be described in greater detail with reference to the drawing, in which.

Figure 1:
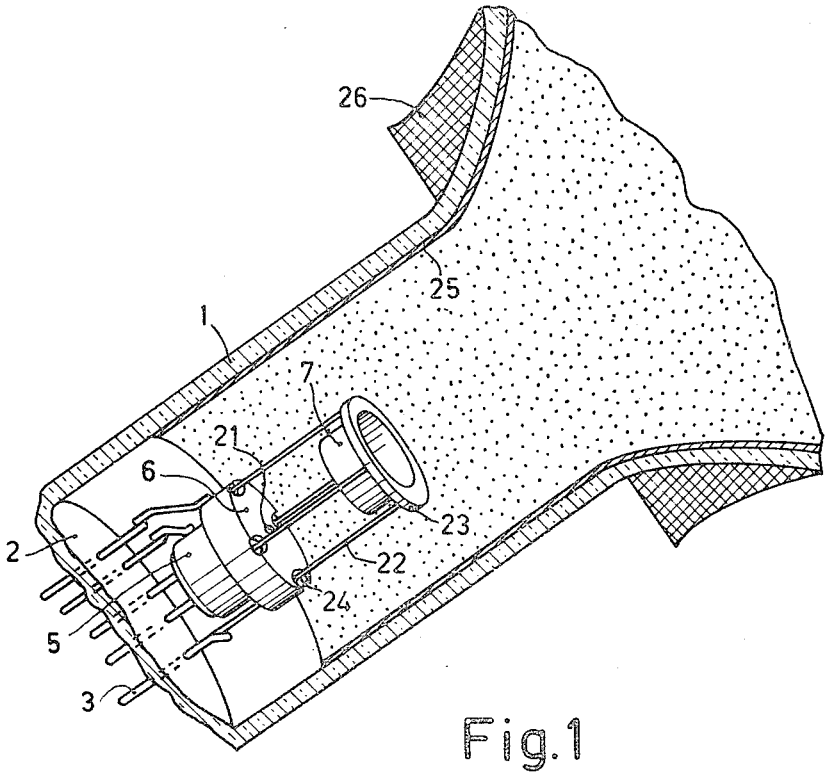
FIG. 1 is a perspective view of an electron gun according to the invention in a neck of a cathode ray tube which is partly broken away.
Figure 2:
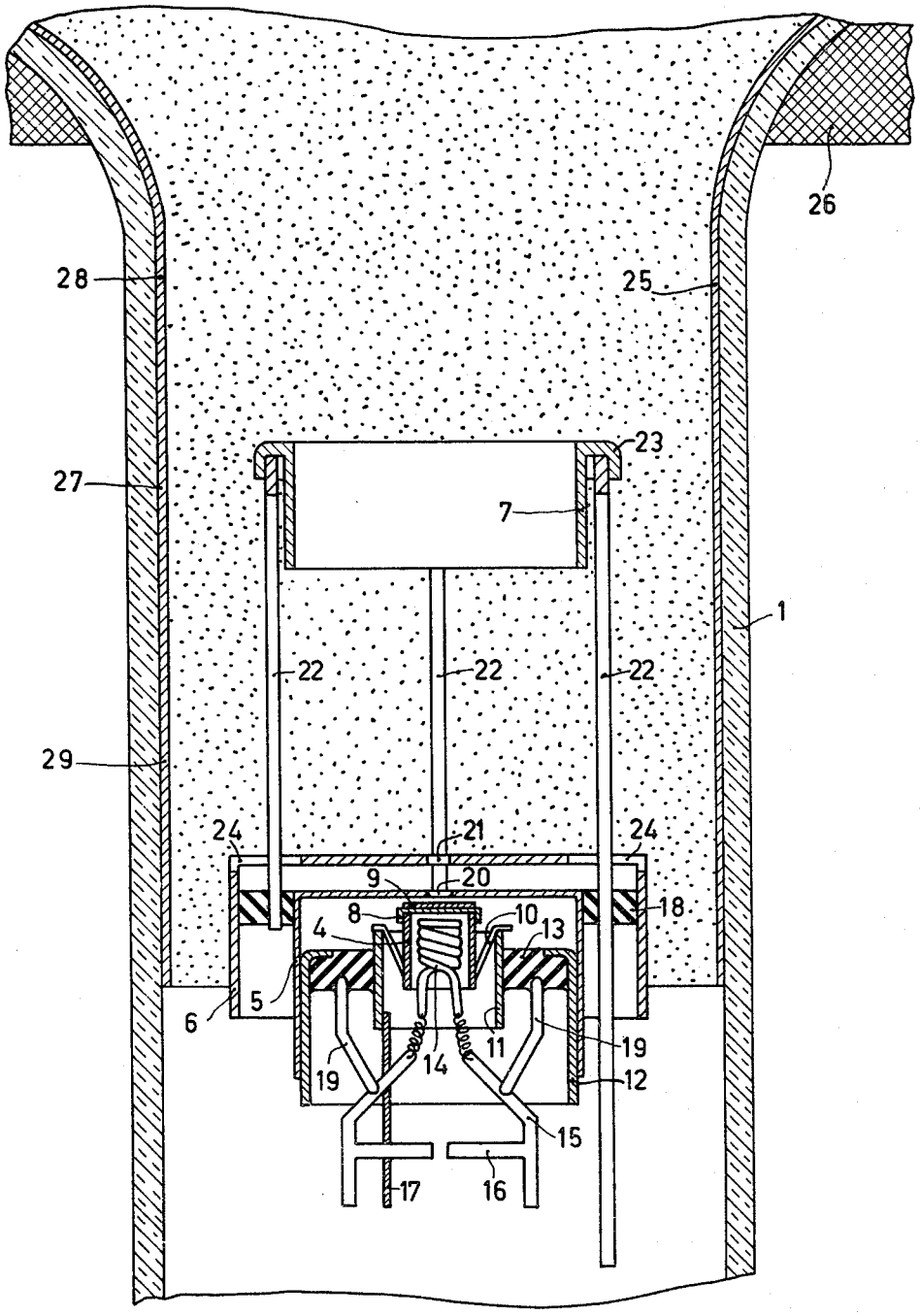
FIG. 2 is an axial sectional view of the electron gun shown in FIG. 1.

FIGS. 1 and 2 show only the neck portion of a cathode ray tube according to the invention. The glass neck 1 has an inside diameter of 24 mm and is sealed at one end by a glass sealing plate 2 which has a number of sealed lead-through pins 3. On said leadthrough pins is mounted an electron gun which comprises a cathode 4, a control electrode 5, an anode 6 and a focusing electrode 7 centered along one axis. The cathode is a hollow cylinder which is sealed at one end by a cap 8 which is covered with an electron-emissive material 9. The cathode is furthermore secured to a first metal supporting sleeve 11 by means of three metal supporting strips 10. A second metal supporting sleeve 12 is secured to the first supporting sleeve by means of a ceramic ring 13 in which two supporting poles 19 are sealed for the filament 14 present inside the cathode 4. The two ends of the filament are secured to a connection brace 15 of which the transverse connection 16 has been interrupted after mounting the filament. The cathode can be brought at the desired potential relative to the control electrode 5 via a current supply conductor 17 which is connected to the supporting sleeve 11.

Said control electrode which has a central aperture 20 fits over the supporting sleeve 12 with a slight amount of play and is welded thereto after having adjusted a distance of approximately 65$\mu$m between the cathode and the said control electrode. The anode 6 which has a central aperture 21 is fixed at an axial distance of approximately 200$\mu$m from the control electrode 5 by means of a second ceramic ring 18. The axial distance between the anode 6 and the focusing electrode 7 is approximately 7.2 mm and is determined by means of four metal pins 22 which are sealed at one end in the ceramic ring 18 and are soldered at the other end to the focusing electrode 7, namely below an edge thereof which has been bent to form a collar 23. Of the four pins which are led into the anode 6 through the same number of apertures 24, one pin is connected to a lead-through pin 3 so as to be able to give the focusing electrode the desired potential. the pins have a thickness of 0.65 mm and consist of a material the coefficient of linear expansion of which is adapted to that of the ceramic ring 18. The focusing electrode 7 which has an inside diameter of 8 mm and a length of 3 mm consists of a non-magnetic material, for example, stainless steel or a copper-nickel alloy. On the side remote from the gun the focusing electrode constitutes an accelerating lens in combination with a conductive coating 25 provided on the interior of the neck 1. Said conductive coating which may be, for example, graphite, extends at one end in the neck to beyond the anode 6 and at the other end adjoins the conductive coating commonly used for said tubes, between the target not shown in the drawing and the electron gun. The conductive coating may be a low-ohmic layer or a high-ohmic layer, high-ohmic being understood to mean a layer having a resistance of more than 500 ohms per square. such high-ohmic layers are sometimes used to protect the components of the circuit in which the cathode ray tube is incorporated in case a possible electric breakdown occurs in the tube. The four supporting members 22 in cooperation with the conductive coating 25 constitute an electrostatic octupole lens. The four positive poles are present between the supporting members in places which are regularly distributed over the circumference of the neck, while the four poles having a comparatively lower potential are formed by the supporting members themselves. The focusing action of said octupole lens is such that the electron beam obtains a rectangular cross-section. If desired, a pre-correction of the electron beam can be obtained by providing the control electrode 5 and the anode 6 with a rectangular central aperture instead of the usual circular aperture. The orientation of the rectangular spot thus formed on the target is such that two opposite sides extend parallel to the direction in which the lines are successively written on the target by deflection of the electron beam in two mutually perpendicular directions. Said deflection is produced by a system 26 of deflection coils arranged co-axially around the tube and shown diagrammatically in the drawing.

The above-described gun can be operated at the following voltages:

| | |
|---|---|
| cathode between 0 and | 60 V |
| control electrode | 0 V |
| anode | 130 V |
| focusing electrode | 0–130 V |

-continued

| | |
|---|---|
| conductive coating | 18–20 kV. |

The variable voltage at the cathode serves to control the beam.

The voltage at which the focusing electrode should be operated mainly depends upon the distance of said electrode to the anode, while the length of the electrode also plays an important role. It has been found, for example, that when the distance anode-focusing electrode is increased from 7.2 mm to 10.5 mm, the voltage at the focusing electrode should be increased to 1000 Volts so as to obtain a result which can be compared with the case wherein the said distance is 7.2 mm. By also reducing the length of the focusing electrode to 2.5 mm, the above-mentioned lower voltages at the focusing electrode were again sufficient.

Although the embodiment describes one single conductive coating, it is also possible to interrupt said coating at the level of the focusing electrode in a place denoted by 27. In this manner two conductive layers 28 and 29 are formed which can convey potentials which differ from each other. for example, the layer 28 may remain connected to the high voltage contact not shown in the drawing, while the layer 29 obtains its voltage via a contact spring which is connected electrically, for example, to a lead-through pin 3. If desired, more degrees of freedom of the system are hence available.

Figure 3:
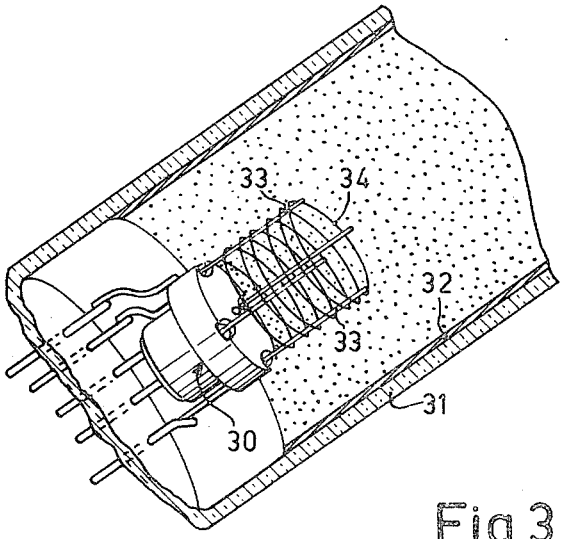
FIG. 3 is a perspective view of another embodiment of the electron gun shown in FIG. 1.

The electron gun shown in FIG. 3 does not differ from that shown in FIG. 1 as far as the triode part 30 is concerned. In this embodiment also the conductive coating 32 extends in the neck 31 of the tube to beyond the anode. However, the focusing electrode does not consist of a cylindrical sleeve but is formed by a wire 34 having a diameter of 130$\mu$m and wound helically on the supporting members 33 with a pitch of 1 mm. The grid thus formed has a length of 10 mm and is operated at a voltage of 0 Volt with a distance to the anode of 2 mm. In this case also, many variations in the pitch and the diameter of the wire are possible. As regards the fundamental operation, said embodiment does not differ or differs hardly from that described with reference to FIGS. 1 and 2.

After the above-described embodiments it will be obvious that many variations are possible without departing from the scope of this invention as regards the shape and dimensions of the electrodes, their mutual distances and the voltages at which they can be operated.

What is claimed is:

1. A cathode ray tube comprising within an evacuated envelope, means to generate an electron beam propagating along an axis, focusing means to focus said electron beam to a spot on a target arranged substantially at right angles to the axis, an electrically conductive coating provided on the interior of said envelope and surrounding said focusing means, said focusing means including a focusing electrode facing the target and a plurality of axially arranged, electrically conductive elongate members supporting said focusing electrode and being electrically connected thereto, said members in combination with said coating constituting an electrostatic multipole lens cooperating with said focusing electrode.

2. A cathode ray tube as claimed in Claim 1 wherein the supporting members of the focusing electrode consist of four mainly axially extending metal pins which are present at the same distance from each other and which constitute an electrostatic octupole with the said conductive coating.

3. A cathode ray tube as claimed in claim 1 in which the means to generate an electron beam comprise a triode portion having a cathode, a control electrode and an anode which are arranged so as to be centred along said axis and in which at least the anode and the control electrode are mechanically connected together by means of an electrically insulating material, and the supporting members of the focusing electrode being connected in the said insulating material.

4. A cathode ray tube as claimed in claim 3, wherein the anode has a number of apertures through which the supporting members of the focusing electrode are led.

5. A cathode ray tube as claimed in claim 1, wherein at least one of the said supporting members also serves as a supply conductor of the electric potential for the focusing electrode.

6. A cathode ray tube as claimed in claim 1, wherein the focusing electrode has a collar below which the ends of the supporting members are secured.

7. A cathode ray tube as claimed in claim 1, wherein the focusing electrode consists of a grid formed by at least one wire wound helically around the supporting members.

8. A cathode ray tube as claimed in claim 1, wherein the said conductive coating is interrupted at the level of the focusing electrode, and means being present to supply suitable potentials to the resulting coatings separated from each other.

* * * * *